US005785034A

United States Patent [19]

Moedinger et al.

[11] Patent Number: 5,785,034

[45] Date of Patent: Jul. 28, 1998

[54] EXHAUST GAS RECIRCULATION APPARATUS WITH A CLOSING ELEMENT ACTUATABLE IN THE INTAKE CONDUIT

[75] Inventors: Hermann Moedinger, Weinstadt; Thomas Linke, Waiblingen, both of Germany

[73] Assignee: Robert Bosch GmbH, Stuttgart, Germany

[21] Appl. No.: 894,834

[22] PCT Filed: Aug. 23, 1996

[86] PCT No.: PCT/DE96/01563

§ 371 Date: Aug. 29, 1997

§ 102(e) Date: Aug. 29, 1997

[87] PCT Pub. No.: WO97/24522

PCT Pub. Date: Jul. 10, 1997

[30] Foreign Application Priority Data

Dec. 29, 1995 [DE] Germany ..... 195 49 107.6

[51] Int. Cl.[6] ..... F02M 25/07

[52] U.S. Cl. ..... 123/568; 123/571

[58] Field of Search ..... 123/568, 569, 123/571

[56] References Cited

U.S. PATENT DOCUMENTS

| | | | |
|---|---|---|---|
| 4,300,515 | 11/1981 | Straubel et al. | 123/568 |
| 4,327,699 | 5/1982 | Reiff et al. | 123/568 |
| 4,646,705 | 3/1987 | Babitzka et al. | 123/571 |
| 4,671,246 | 6/1987 | Maisch | 123/568 |
| 5,163,295 | 11/1992 | Bradshaw | 123/568 |
| 5,207,714 | 5/1993 | Hayashi et al. | 123/568 |
| 5,333,456 | 8/1994 | Bollinger | 123/568 |
| 5,492,104 | 2/1996 | Elder et al. | 123/568 |
| 5,606,957 | 3/1997 | Feucht | 123/571 |
| 5,609,143 | 3/1997 | Schellenberg et al. | 123/568 |
| 5,669,364 | 9/1997 | Everingham | 123/568 |

FOREIGN PATENT DOCUMENTS

| | | |
|---|---|---|
| 349729 | 1/1990 | European Pat. Off. . |
| 2238055 | 2/1975 | France . |
| 4227739 | 2/1994 | Germany . |
| 1388032 | 3/1975 | United Kingdom . |

*Primary Examiner*—Willis R. Wolfe

*Attorney, Agent, or Firm*—Edwin E. Greigg; Ronald E. Greigg

[57] ABSTRACT

The invention relates to an apparatus for exhaust gas recirculation having an exhaust gas delivery conduit connected to an intake conduit, wherein the exhaust gas discharge conduit in the intake conduit is openable and closable via a closing element actuated by an adjusting drive. To that end, a substantially cylindrical exhaust gas delivery tube, as part of an exhaust gas delivery neck protrudes into the intake conduit approximately perpendicular to the fresh gas stream, which has an outlet opening in its cylindrical wall. Disposed above the outlet opening is a rotary slide bell, as the closing element, which at least regionally surrounds the exhaust gas delivery tube protruding into the intake conduit. The rotary slide bell is coupled to an electric pivoting motor acting as an adjusting drive. The apparatus is one in which only minimal forces caused by the flow of exhaust gas and fresh gas act upon the closing element and its adjusting drive.

3 Claims, 1 Drawing Sheet

EXHAUST GAS RECIRCULATION APPARATUS WITH A CLOSING ELEMENT ACTUATABLE IN THE INTAKE CONDUIT

PRIOR ART

The invention is based on an exhaust gas recirculation apparatus having a closing element actuatable in the intake conduit.

Such apparatuses are known. In some versions, exhaust gas delivery conduits are passed laterally into the intake conduits and are opened or closed there, for instance via cup valves. To that end, the closure cups of the valves are placed on the respective opening of the corresponding exhaust gas delivery conduit in the intake conduit, or are lifted by that exhaust gas delivery conduit. In unregulated apparatuses, the drive for adjusting the closure cup is accomplished via negative pressure boxes. A comparable apparatus to this is known from U.S. Pat. No. 3,901,203. However, in that patent, the negative pressure box moves a hinged flap. The entire exhaust gas recirculation valve is also seated in an exhaust gas line located outside the intake conduit. British Patent GB 1 388 032 also describes an exhaust gas recirculation valves located outside the intake conduit.

More recent exhaust gas recirculation valves are driven in regulated fashion. To that end, the known closure cup in the intake conduit, for instance, is moved axially toward or away from the opening of the exhaust gas delivery conduit with the aid of a pneumatic drive. By the drive-dictated elasticity, the exhaust gas pressure acting on the valve cup, and the flow conditions in the intake conduit, undesirable inaccuracies arise in the case of infinitely variable adjustment, especially in the low-load range when valve gaps are small.

Complicated constructions are also known in which the valve cup or the closing member is moved with the aid of a geared motor.

ADVANTAGES OF THE INVENTION

The subject of the invention is an exhaust gas recirculation apparatus in which among other elements the exhaust gas delivery conduit and the adjusting drive are disposed in the intake conduit in such a way, and the valve parts are embodied in such a way, that only minimal forces caused by the flow of exhaust gas and fresh gas act upon the closing element and its drive. To that end, a substantially cylindrical exhaust gas delivery tube as part of an exhaust gas delivery neck protrudes into the intake conduit, virtually perpendicular to the fresh gas flow, and the neck has an outlet opening in its cylindrical wall. A rotary disk bell is disposed as a closing element above the outlet opening and it at least intermittently surrounds the exhaust gas delivery tube protruding into the intake conduit. The rotary disk bell is coupled with an electric pivoting motor acting as the adjusting drive.

The electric pivoting motor is for instance a so-called electromagnetic rotary adjuster. The coil winding of this pivoting motor is acted upon by a pulsating direction current. The resultant torque of the rotor acts counter to a restoring spring. With respect to the type of rotary adjuster, the coil winding together with an iron yoke may form the stator, and a permanent magnet together with the pivoting shaft can form the rotor, among other elements. The pivoting motion of the closing element may also be accomplished with the aid of a stepping motor.

To generate a good mixture of fresh and exhaust gas, the outlet opening of the exhaust gas delivery tube protruding into the intake conduit is disposed approximately crosswise and downstream of the exhaust gas delivery tube, in terms of the flow direction of the fresh gas stream. As a result of this arrangement, exhaust residues can hardly become deposited in the region of the valve or throttle valve. In the case of curved intake conduits or conduits with other flow obstacles, the exhaust gas for achieving an optimal mixing can also be introduced obliquely to the fresh gas stream. To that end, the exhaust gas delivery tube can be mounted pivotably in the form of a component insertable separately into the exhaust gas delivery neck.

As a rule, the closing element or the rotary slide bell is in alignment relative to the exhaust gas delivery neck and the exhaust gas delivery tube. The center lines of the exhaust gas delivery neck and the rotary slide bell may also be slightly offset, parallel to one another. An offset that creates a small gap in the region of the outlet opening and a large gap on the opposite side of the exhaust gas delivery tube brings about good valve tightness without the risk of seizing of the rotary slide bell from soiling in the gap.

The exhaust gas recirculation apparatus has a closing element, whose actuation, because of its design, requires only slight force. Moreover, because of the bell shape of the closing element, there is on the one hand high security against any inducement to vibrate from the exhaust gas system, and moreover it is secure against jarring relative to its pivot axis, because of an intrinsically balanced distribution of mass. The direct drive also enables highly dynamic and precise adjustment behavior.

BRIEF DESCRIPTION OF THE DRAWING

The drawing is a cross section view illustrating the relative parts.

DETAILED DESCRIPTION OF THE DRAWING

Figure 1:
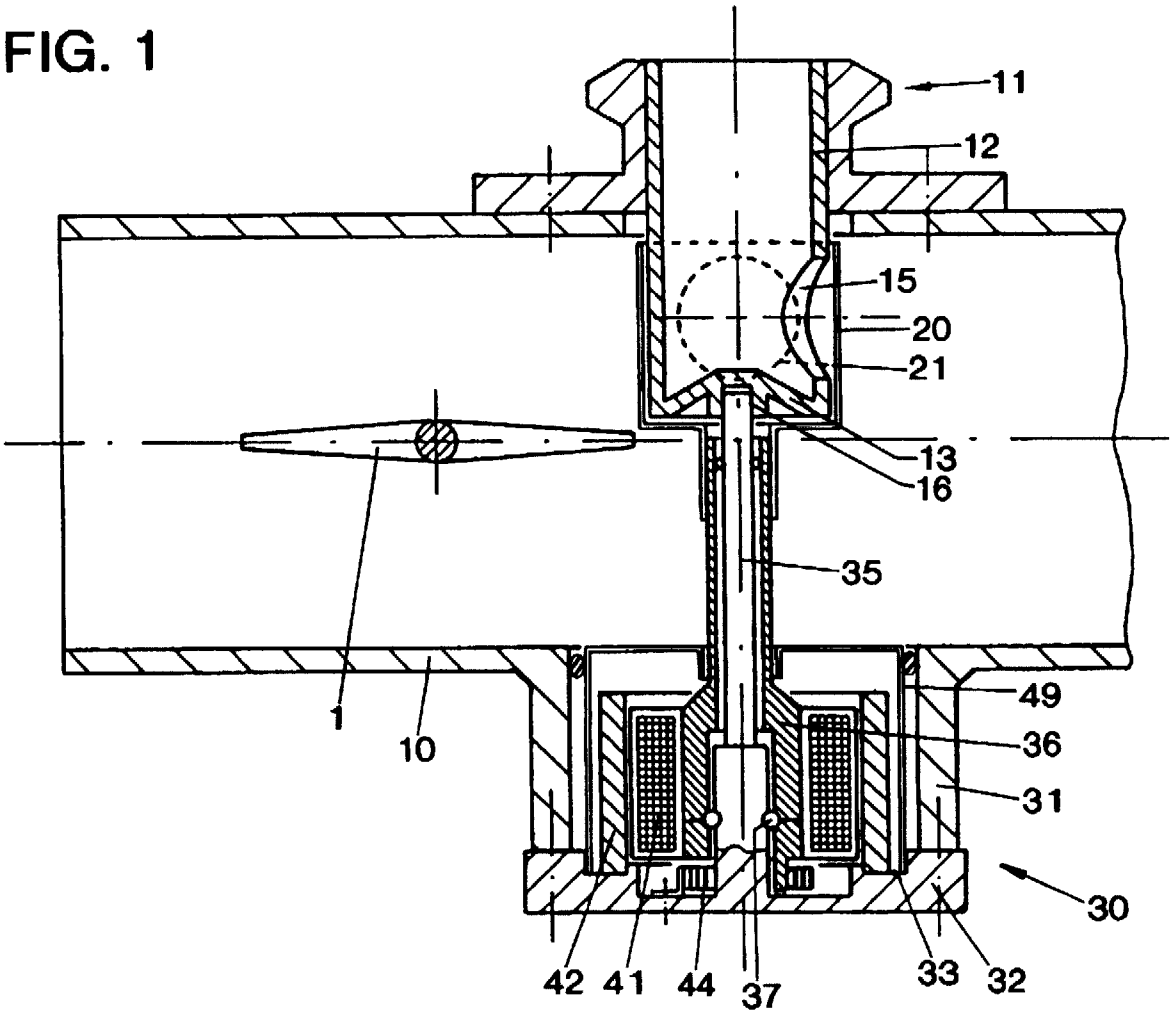

FIG. 1 shows an exhaust gas recirculation valve, which is disposed in an intake conduit (10) of an internal combustion engine. The exhaust gas is introduced into the intake conduit (10) downstream of a throttle valve (1) in the direction of the fresh gas flow. To that end, an exhaust gas delivery neck (11) is disposed on the outer wall of the intake conduit (10), and an exhaust gas delivery line, not shown here, is flanged to this neck. A separate exhaust gas delivery tube (12) is inserted into the exhaust gas delivery neck (11), for instance. The exhaust gas delivery tube (12), which may also be a tubular portion formed onto the exhaust gas delivery neck (11), has a cylindrical outer contour and is closed off with a bottom (13). In the portion protruding into the intake conduit (10), the exhaust gas delivery tube (12) has a round outlet opening (15). The imaginary center line at the outlet opening (15) extends parallel, for instance, to the center line of the intake conduit (10). A pivotable rotary slide bell (20) is positioned below the portion of the exhaust gas delivery tube (12) that protrudes freely into the intake conduit (10). The pivot axis of the rotary slide bell (20) corresponds to the center line of the exhaust gas delivery tube (12).

The rotary slide bell (20) in FIG. 1 is a thin-walled main cylinder with a bottom. Disposed on the outside of the bottom is a bearing cylinder of smaller diameter, concentric with the main cylinder. The main cylinder has a bore (21), that serves as a rotary slide opening, which by way of example is coincident with the outlet opening (15) when the exhaust gas recirculation valve is open. Since the exhaust gas recirculation valve is shown in the closed state in FIG. 1, the rotary slide opening (21) on the main cylinder is located on the back side of the exhaust gas delivery tube (12) and is thus shown only in dashed lines.

The outlet opening (15) of the exhaust gas delivery tube (12) and the rotary slide opening (21) may have areas of different size and different contours. The cross sections of the openings (15) and (21) can optionally be adapted to one another such that each pivot angle of the rotary slide bell (20) corresponds to a certain opening cross section, so that the opening cross section increases as the pivot angle increases, for example.

The rotary slide bell (20) may also have a plurality of openings in the region of the main cylinder. In this way, various opening cross sections per pivot angle can for instance be realized.

The bottom of the rotary slide bell (20) may have a plurality of openings or bores, to allow exhaust gas that arrives in the gap space between the exhaust gas delivery tube (12) and the rotary slide bell (20) to escape. Because such recesses are provided, no axial force acting on the rotary slide bell (20) can develop. Moreover, the exhaust gas escaping at the edge of the bottom does not penetrate into the adjusting drive (30).

For bearing and adjusting the rotary slide bell (20), an electric pivoting motor (30) is used. It is accommodated in a drive housing (31), which protrudes in the form of a tube from the intake conduit (10). The drive housing (31) is oriented such that its center line coincides with the center line of the bore for receiving the exhaust gas delivery neck (11) and at the same time intersects the center line of the intake conduit (10) at a right angle. The outward-pointing end face of the drive housing (31) is also oriented so that it is normal to the center line of the housing.

A rotary slide flange (32), which is adjoined by a rotary slide shaft (35), is mounted on the plane end face of the tubular drive housing (31). The free end of the rotary slide shaft (35) engages a bearing bore (16) located in the bottom (13) of the exhaust gas delivery tube (12). When the electric pivoting motor (30) is installed in the intake conduit (10), the rotary slide shaft (35) is positioned and screwed to the drive housing (31) via the rotary slide flange (32) in such a way that it engages the bearing bore (16) of the exhaust gas delivery tube (12) without faulty gripping or canting.

The rotary slide bell (20), with the aid of the bearing cylinder, is seated on a hollow shaft (36) that has double roller bearing support on the rotary slide shaft (35). The roller bearing (37) located in the vicinity of the rotary slide flange (32) is a fixed bearing. Optionally, the drive housing (31) can be subjected to slight overpressure, to protect the roller bearings against the possible invasion of exhaust gas particles. A gap seal can for instance also be provided upstream of the free end of the hollow shaft 36, between the rotary slide bell (20) and the rotary slide shaft (35) or the bottom (13).

Instead of the two roller bearings, slide bearings or cross spring joints can also be used. The latter are less vulnerable to heat and dirt.

Seated on the rear portion of the hollow shaft (36) is a coil (41). These two components, among others, form the rotor of the electric pivoting motor (30). A magnetic stator (42) is disposed around the coil (41). It is secured in an annular groove (33) that is present in the rotary slide flange (32).

The electric pivoting motor (30) has a pivoting range of approximately 90°, limited by stops not shown. The closure of the exhaust gas recirculation valve is effected by a spiral spring (44), which is located between the rotary slide flange (32) and the rear face end of the hollow shaft (36). To that end, the spiral spring (42) is secured on the hollow shaft (36) and on the rotary slide flange (32).

To protect the electric pivoting motor (30) against contamination, a thin-walled, cup-shaped cap (49) is disposed between the drive housing (31) and the stator (42). The cap (49) is firmly clamped to the outer edge of the annular groove (33) provided in the rotary slide flange (32). In the inner wall region of the intake conduit (10), an O ring is clamped in place for sealing off the transition between the cap (49) and the drive housing (31). There is a gap seal between the hollow shaft (36) and the cap (49).

As an alternative to the construction described thus far, the possibility also exists of equipping the electric pivoting motor (30) with its own housing, so that it forms an assembly group together with the rotary slide shaft (35) and the rotary slide bell (20). The assembly group can then be flanged directly to the intake conduit (10), without the intake conduit requiring a formed-on drive housing (31) of the kind shown in FIG. 1. For insertion of the rotary slide bell (20), the intake conduit (10) has a corresponding opening for the purpose.

In operation of the internal combustion engine, a portion of the exhaust gas is admixed with the fresh gas via the exhaust gas recirculation valve, depending on the opening state. To that end, in the exemplary embodiment shown in FIG. 1, the rotary slide bell (20) is kept open, counter to the closing force of the spiral spring (44), by means of a controlled supply of electric current to the coil (41). An opening motion is effected by rotating the rotary slide bell (20) counterclockwise.

The foregoing relates to preferred exemplary embodiments of the invention, it being understood that other variants and embodiments thereof are possible within the spirit and scope of the invention, the latter being defined by the appended claims.

The invention claimed and desired to be secured by Letters Patent of the United States is:

1. An apparatus for exhaust gas recirculation having an exhaust gas delivery conduit connected to an intake conduit, wherein the exhaust gas delivery conduit in the intake conduit is openable and closable via a closing element actuated by an adjusting drive comprising, an exhaust gas delivery tube (12) having a substantially cylindrical wall, as part of an exhaust gas delivery neck (11) that protrudes into the intake conduit (10) approximately perpendicular to a fresh gas stream;

the exhaust gas delivery tube (12) has an outlet opening (15) in the cylindrical wall;

the closing element is a rotary slide bell (20), which at least regionally surrounds the exhaust gas delivery tube (12) that protrudes into the intake conduit (10); and the rotary slide bell (20) is coupled with an electric pivoting motor (30) acting as an adjusting drive.

2. The apparatus of claim 1, in which the outlet opening (15) is disposed approximately crosswise and downstream of the exhaust gas delivery tube (12) in terms of the flow direction of the fresh gas stream.

3. The apparatus of claim 1, in which an imaginary center line of the exhaust gas delivery neck (11) and of the rotary slide bell (20) are identical.

* * * * *